US011280073B1

(12) United States Patent
Jeng et al.

(10) Patent No.: US 11,280,073 B1
(45) Date of Patent: Mar. 22, 2022

(54) SMART WATER FAUCET WITH FAR-UV DISINFECTION AND AUTOMATIC SOAP AND SANITIZER DISPENSER

(71) Applicant: National Taiwan University of Science and Technology, Taipei (TW)

(72) Inventors: Jeng-Ywan Jeng, Taipei (TW); Aamer Nazir, Taipei (TW); Yeabsra Mekdim Hailu, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 0 days.

(21) Appl. No.: 17/075,666

(22) Filed: Oct. 20, 2020

(51) Int. Cl.
*E03C 1/046* (2006.01)
*E03C 1/05* (2006.01)

(52) U.S. Cl.
CPC ..... *E03C 1/046* (2013.01); *E03C 1/057* (2013.01)

(58) Field of Classification Search
CPC ..... E03C 1/046
USPC ..... 4/623, 619; 137/562; 239/16, 569; 251/131
See application file for complete search history.

(56) References Cited

U.S. PATENT DOCUMENTS 6,019,130 A * 2/2000 Rump ..... E03C 1/057 137/601.01
6,513,787 B1 * 2/2003 Jeromson ..... E03C 1/057 137/559
8,375,934 B2 * 2/2013 Zheng ..... F24S 10/95 126/588
8,407,827 B1 * 4/2013 Friedman ..... E03C 1/057 4/623
8,572,772 B2 * 11/2013 Wolf ..... E03C 1/057 4/623
2006/0214016 A1 * 9/2006 Erdely ..... G05D 23/1393 236/12.12
2008/0163942 A1 * 7/2008 Boey ..... E03C 1/057 137/624.11
2011/0185493 A1 * 8/2011 Chen ..... G05D 23/1927 4/623
2016/0177550 A1 * 6/2016 Sawaski ..... E03C 1/057 137/78.1
2017/0306596 A1 * 10/2017 Sawaski ..... E03C 1/0412

* cited by examiner

*Primary Examiner* — Lori L Baker

(57) ABSTRACT

A smart faucet equipment providing water for washing and sanitizing liquid for dry hand wash. A user may activate different sensors to provide different liquid according to their requirement. The smart faucet equipment of the invention provides water or sanitizing liquid according to the sensors activated by the user. The smart faucet equipment of the invention provides control scheme of regulation of the time period for providing water or sanitizing liquid according to the user's requirement, whereby the user may wash his/her hands without manual operation.

12 Claims, 7 Drawing Sheets

SMART WATER FAUCET WITH FAR-UV DISINFECTION AND AUTOMATIC SOAP AND SANITIZER DISPENSER

BACKGROUND OF THE INVENTION

Field of the Invention

The invention relates to a technical field of liquid provision, and more particularly to a smart faucet equipment capable of providing washing water with liquid soap or sanitizing liquid according to activation of different sensors.

Description of the Related Art

A water supply system of piped water provides washing water in our daily life. A user may clean his/her body or mouth with the water provided by the water supply system. The water supplied by the water supply system can be conveniently obtained through a washing equipment such as a faucet when the user needs the water. The conventional facet usually has a handle. The user operates the handle to open the faucet, whereby the water flows from the faucet.

Since the faucet must be operated by the user manually, the user opens the faucet by hand to wet his/her hands and then rubs the hands with soap, but the faucet is usually maintained open when the user uses soap or liquid hand wash to rub his/her hand. Therefore, the water is unused but continues to flow out of the faucet, which causes waste of water. If the user closes the faucet when he/she begins to rub the hands with the soap, he/she must open the faucet again with the hands full of soap to wash the hands. After the hand wash are finished, the soap on handle of the faucet must be cleaned by the user himself/herself, which is inconvenient. Sometimes, the user may forget to clean the handle and leave. If the faucet is located in a public place, the uncleaned handle may cause sanitation problems.

In addition, when the user needs the sanitizer, such as alcohol, to wash and disinfect the hands, an additional device or equipment is necessary for reception and provision of the sanitizer, and the user may need to go to another place to use the sanitizer, which is also inconvenient for the user.

Finally, since hands are one of the most common ways that viruses spread from one person to another, faucets with manual handles cause cross contamination between users and spread these viruses and other disease-causing microorganisms.

BRIEF SUMMARY OF THE INVENTION

The objective of the invention is to provide a smart faucet equipment capable of providing water and liquid soap for wash and providing sanitizer for disinfection. A user may activate different sensors according to his/her requirements, and the smart faucet equipment provides water with liquid soap or sanitizer according to the sensor activated by the user. The time periods of water provision and sanitizer provision are determined by the control module which precisely controls the opening and closing of valves to provide the required fluid in the right amount. Therefore, the smart faucet equipment operates automatically and completely touch-free for the user to wash or disinfect hands according to his/her need.

The invention provides a smart liquid providing equipment. The smart liquid providing equipment in accordance with an exemplary embodiment of the invention includes a water supply line, sanitizer supply line, liquid soap supply line, a solenoid valve, two liquid pumps, control module, and containers for the liquid soap and sanitizer. The faucet on the other hand includes a water outlet, a first liquid outlet and a second outlet. The valve is connected to the water outlet and a water source. The first liquid supply module is connected to the first liquid outlet. The second liquid supply module is connected to the second liquid outlet. The control module is electrically connected to the valve, the first liquid supply module and the second liquid supply module. The first sensor is electrically connected to the control module. The second sensor is electrically connected to the control module. When a user's hand approach the first sensor it sends an electrical signal to the microcontroller and the microcontroller will open the solenoid valve letting the washing system, which includes water and liquid soap, to begin. When a user's hand approach the second sensor it sends an electrical signal to the microcontroller and the microcontroller will trigger the sanitizer pump to dispense sanitizer on the user's hand through the faucet.

In another exemplary embodiment, the smart faucet contains a set of light emitting diodes surrounding the outlet of the faucet which are capable of emitting far-UV light which is around 222 nm, which provides extra disinfection to the user's hands in both the washing and the sanitizer systems.

In yet another exemplary embodiment, the liquid soap supply module (the first liquid supply module) includes the first sensor, a liquid soap pump (first liquid pump), and a soap container (first liquid container). The liquid soap pump connects the soap container and the soap outlet on the faucet. It is also electrically connected to the control module which actuates it when the sensor connected to it is activated.

In another exemplary embodiment, the sanitizer liquid supply module (the second liquid module) includes the second sensor, a liquid sanitizer pump (second liquid pump), and a sanitizer container (second liquid container). The liquid sanitizer pump connects the sanitizer container and the sanitizer outlet on the faucet. It is also electrically connected to the control module which actuates it when the sensor connected to it is activated.

In yet another exemplary embodiment, the first liquid is washing liquid.

In another exemplary embodiment, the second liquid is sanitizer.

In yet another exemplary embodiment, the first sensor includes a transmitter and receiver members. The transmitter continues transmitting infrared ray all the time and when an object blocks and reflects the rays to the receiver, it generates a signal which is then sent to the microcontroller.

In another exemplary embodiment, the first sensor includes a transmitter and receiver members. The transmitter continues transmitting infrared ray all the time, and it generates a signal which is then sent to the microcontroller when an object blocks and reflects the rays to the receiver.

In yet another exemplary embodiment, the first sensor and the second sensor are placed on the left and right side at the lower part of the faucet in opposite position.

In another exemplary embodiment, the smart faucet equipment/device of the present invention further includes a liquid collecting/draining member disposed under the liquid providing member. The water flowing through the water outlet enters the liquid collecting/draining member.

In yet another exemplary embodiment, the first sensor includes a transmitter and receiver members. The transmitter continues transmitting infrared ray all the time, and it generates a signal which is then sent to the microcontroller when an object blocks and reflects the rays to the receiver.

In another exemplary embodiment, in the sanitizer dispensing system, the faucet will be closed in its initial state. When a user's hand approach the second sensor it will pick a signal and send it to the microcontroller to trigger the sanitizer pump which will automatically dispense a preset amount of hand sanitizer on the user's hand through the sanitizer outlet on the faucet. During this time the first sensor will be inactive and cannot be triggered for the next 5 seconds.

The smart liquid providing equipment of the present invention is provided with the valve providing water and the liquid soap supply module providing soap to user's hand for washing the hands. The smart liquid providing equipment of the present invention is also provided with a sanitizer liquid sanitizer module providing liquid sanitizer for the user to disinfect the hands. The microcontroller in the control module actuates the solenoid valve and soap dispensing system or only the sanitizer system by the signals generated from the first or second sensor, respectively. Since both washing hands and disinfection are performed in the same equipment, the smart faucet equipment is much more convenient for users. In addition, the smart faucet equipment/device inventions determine control schemes according to user's customs and provide water with soap or sanitizer for the user according to these schemes. It also functions automatically by the activation of the sensors making it easy and convenient to use. Users also do not to touch the faucet making it touch-free and prevent cross contamination between users. Hence no public sanitation problems are rendered and more convenience is provided.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
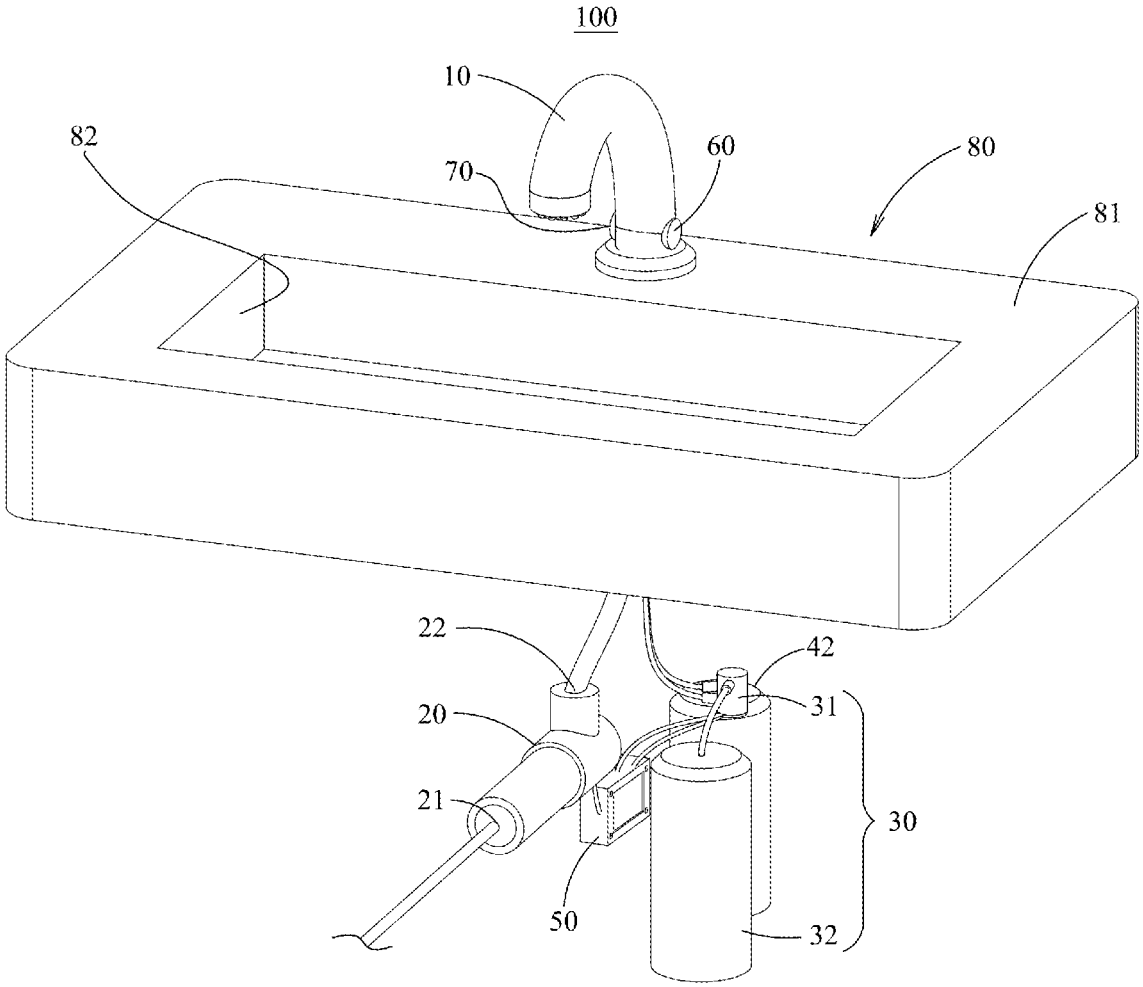
FIG. 1 is a perspective view of an embodiment of a smart faucet equipment/device of the present invention.

The following description is of the best-contemplated mode of carrying out the invention. This description is made for the purpose of illustrating the general principles of the invention and should not be taken in a limiting sense. The scope of the invention is best determined by reference to the appended claims.

Referring to FIGS. 1, 2, 3 and 4, an embodiment of a smart faucet equipment/device is provided. The smart faucet equipment 100 of the present invention includes a liquid providing member 10, a valve 20, a first liquid supply module 30, a second liquid supply module 40, a control module 50, a first sensor 60 and a second sensor 70. The smart faucet equipment 100 further includes a liquid collecting/draining member 80. The smart faucet equipment 100 of the present invention can be applied to washing/disinfecting equipment used in industry or laboratory as well as to general domestic washing equipment.

In the present embodiment, the liquid providing member 10 is a faucet, and the liquid collecting/draining member 80 is a basin. The water discharging from the liquid providing member 10 pours into the liquid collecting/draining member 80. The water can be collected in the liquid collecting/draining member 80 or drained from the liquid collecting/draining member 80. The liquid collecting/draining member 80 is mounted on a wall of a building at a proper height for persons' convenient usage. The liquid collecting/draining member 80 has an upper surface 81 and a depression 82 formed on the upper surface 81. The water or liquid discharges from the liquid providing member 10 enters the depression 82 of the liquid collecting/draining member 80. The upper surface 81 refers to a surface of the liquid collecting/draining member 80 facing a person when the person utilizes the liquid collecting/draining member 80.

Figure 3:
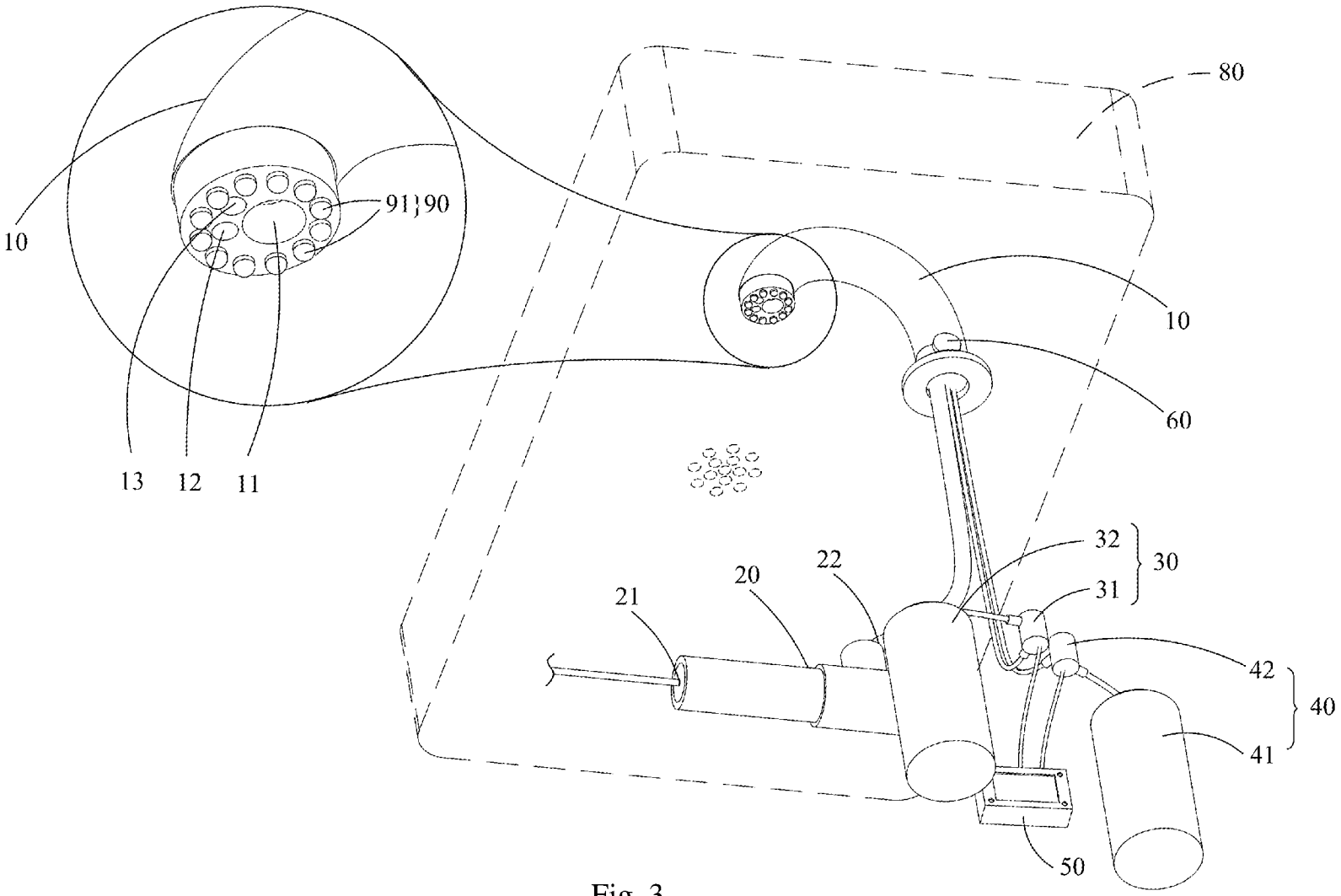
FIG. 3 is another perspective view of the smart faucet equipment/device of FIG. 1.

Referring to FIG. 3, the liquid providing member 10 includes a water outlet 11, a first liquid outlet 12 and a second liquid outlet 13. The piped water or water from other water source discharges from the water outlet 11, and the first liquid outlet 12 and the second liquid outlet 13 provides a first and a second liquid respectively. In the present embodiment, the first liquid includes wash liquid capable of cleaning objects, such as hand wash liquid or liquid soap. The second liquid includes sanitizer capable of disinfecting or sterilizing objects, such as alcohol. In addition, in the present embodiment, the water outlet 11 has a diameter larger than the diameter of the first liquid outlet 12 and the second liquid outlet 13 because the flow rate of water is larger than that of the first liquid or the second liquid. The first liquid outlet 12 and the second liquid outlet 13 can be identical or different depending on requirements. Although the liquid providing member 10 of the present embodiment includes the first liquid outlet 12 and the second liquid outlet 13, the invention is not limited thereto. In another embodiment, the liquid providing member 10 includes more than two liquid outlets providing a plurality of wash liquids or sanitizers corresponding to various purposes of wash or disinfection.

Figure 2:
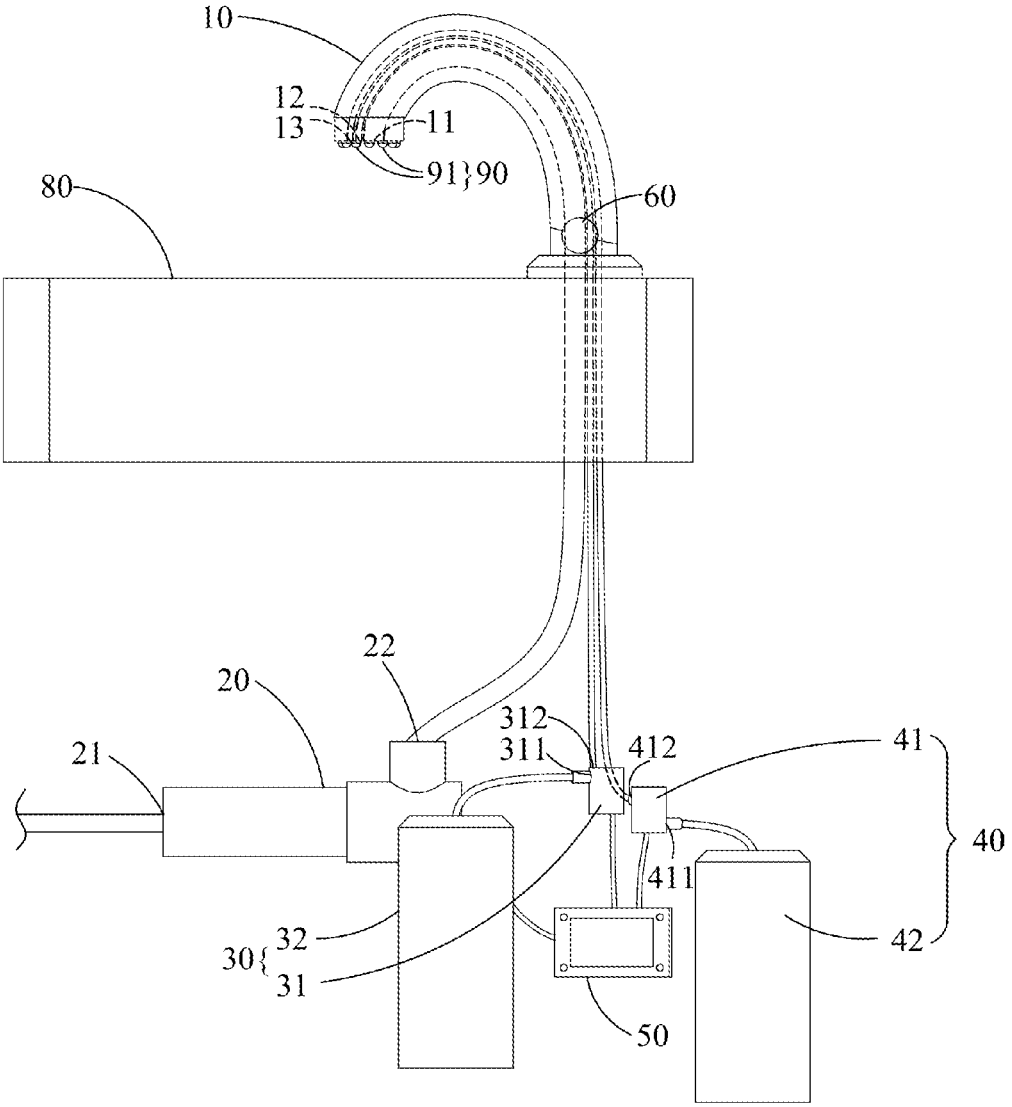
FIG. 2 is a right-side view of the smart faucet equipment/device of FIG. 1.

As illustrated in FIGS. 1 and 2, the valve 20 includes a water entrance 21 and a water exit 22. The water entrance 21 of the valve 20 is connected to a water source which is a water supply system or a water tank. The water exit 22 of the valve 20 is connected to the water outlet 11 by a pipeline. Since the water from the water source flow through the valve 20 to discharge from the water outlet 11 of the liquid providing member 10, the water flow rate depends on the opening condition of the valve 20. In the present embodiment, the valve 20 is a solenoid valve. The amount of the current flowing through the solenoid of the valve 20 determines the opening condition of the valve 20. In the present embodiment, although the valve 20 is mounted under the liquid collecting/draining member 80, the present invention is not limited thereto. In another embodiment, the valve 20 is mounted in the wall. As long as the valve 20 is connected to the water pipeline of the building and the water outlet 11 of the liquid providing member 10, the position of the valve 20 is not limited.

As illustrated in FIGS. 1, 2 and 3, the first liquid supply module 30 is disposed under the liquid collecting/draining member 80. The first liquid supply module 30 includes a first liquid pump 31 and a first liquid container 32. The first liquid pump 31 has a first liquid entrance 311 and a first liquid exit 312. The first liquid container 32 is connected to the first liquid entrance 311 by a pipeline. The first liquid exit 312 is connected to the first liquid outlet 12 of the liquid providing member 10. The first liquid is stored in the first liquid container 32. The first liquid pump 31 pumps the first liquid so as to transfer it from the first liquid container 32 to the liquid providing member 10, and the pressurized first liquid discharges from the first liquid outlet 12. Although the first liquid supply module 30 is disposed under the liquid collecting/draining member 80 in the present embodiment, the present invention is not limited thereto. As long as the first liquid exit 312 of the first liquid pump 31 is connected to the first liquid outlet 12 of the liquid providing member 10, the first liquid supply module 30 can be disposed in other positions for esthetic purpose or convenience of liquid supplementation, for example in the wall or in a cabinet for toiletries above the smart faucet equipment 100.

As illustrated in FIGS. 1, 2 and 3, the second liquid supply module 40 is disposed under the liquid collecting/draining member 80. The second liquid supply module 40 includes a second liquid pump 41 and a second liquid container 42. The second liquid pump 41 has a second liquid entrance 411 and a second liquid exit 412. The second liquid container 42 is connected to the second liquid entrance 411 by a pipeline. The second liquid exit 412 is connected to the second liquid outlet 13 of the liquid providing member 10. The second liquid is stored in the second liquid container 42. The second liquid pump 41 pumps the second liquid so as to transfer it from the second liquid container 42 to the liquid providing member 10, and the pressurized second liquid discharges from the second liquid outlet 13. Although the second liquid supply module 40 is disposed under the liquid collecting/draining member 80 in the present embodiment, the present invention is not limited thereto. As long as the second liquid exit 412 of the second liquid pump 41 is connected to the second liquid outlet 13 of the liquid providing member 10, the second liquid supply module 40 can be disposed in other positions for esthetic purpose or convenience of liquid supplementation, for example in the wall or in a cabinet for toiletries above the smart faucet equipment 100.

As illustrated in FIGS. 1, 2, 3 and 4, the control module 50 is electrically connected to the valve 20, the first liquid pump 31 of the first liquid supply module 30 and the second liquid pump 41 of the second liquid supply module 40. In addition, the control module 50 is further electrically connected to the first sensor 60 and the second sensor 70. In the present embodiment, the first sensor 60 and the second sensor 70 are disposed on opposite sides of the liquid providing member 10, whereby the probability of mis-activating the first senor 60 or the second sensor 70 is reduced when the user choses to activate either the first sensor 60 or the second sensor 70. The control module 50 includes a processor and a memory. Control programs and various setting parameters are saved in the memory. The processor receives the first signal from the first sensor 60 and the second signal from the second sensor 70 and executes the control programs according to the setting parameters to properly operate the valve 20, the first liquid pump 31 and the second liquid pump 41. For example, the processor may control the opening condition of the valve 20 with the pulse width modulation (PWM) signal.

Figure 4:
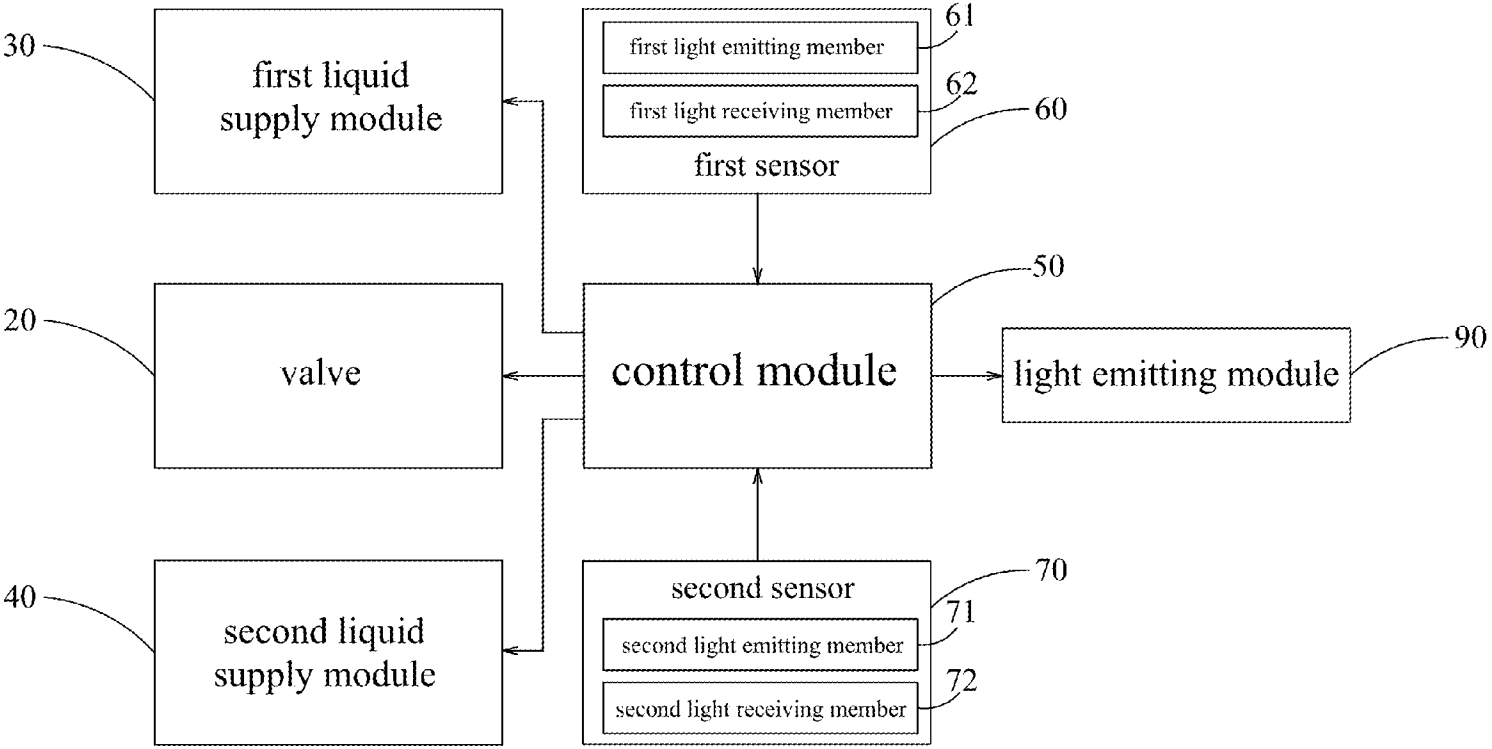
FIG. 4 is a block diagram of an embodiment of a smart faucet equipment/device of the present invention.

In the present embodiment, the first sensor 60 and the second sensor 70 detect proximity of an object with infrared ray. As illustrated in FIG. 4, the first sensor 60 includes a first light emitting member 61 and a first light receiving member 62. The first light emitting member 61 continues to emit infrared ray, and the first sensor 60 generates the first signal when the first light receiving member 62 receives an infrared ray reflected by an object, such as the user's hand. In the present embodiment, the first light emitting member is a light emitting diode emitting infrared ray, and the first light receiving member is a photo diode which generates current when the infrared ray is received. If no object approaches the first sensor 60, then no reflected infrared ray is received by the first senor 60. If an object, such as the user's hand, approaches or passes the first senor 60, the infrared ray emitting from the first light emitting member is reflected by the object and received by the first sensor 60, whereby the first sensor 60 generates the first signal. The second sensor 70 includes a second light emitting member and a second light receiving member. The second light emitting member continues to emit infrared ray. When the second light receiving member receives the reflected infrared ray, the second sensor 70 generates the second signal.

Furthermore, the control module 50 is also electrically connected to an input module and a display module. The user can input various parameters to the control module 50 through the input module, and the display module displays various conditions of the smart liquid providing equipment. For example, the display module displays the operation mode of the smart liquid providing equipment, such as a wash mode or a disinfection mode, the liquid amount of the first liquid container 32 and the second liquid container 42 and the temperature of the water passing through the valve 20. The input module and the display module can be integrated in a touch screen which can be disposed above the liquid providing member 10 and the liquid collecting/draining member 80 for the user to operate and watch.

The control module 50 further includes a power supply providing electrical power for the processor of the control module 50 as well as the valve 20, the first liquid pump 31 and the second liquid pump 41. Although the control module 50 is disposed under the liquid collecting/draining member 80 of the present embodiment as illustrated in FIGS. 1 to 3, the pipeline of water, the first liquid and the second liquid are also mounted under the liquid collecting/draining member 80 so that the control module 50 easily malfunctions due to the humidity caused by the pipelines. Therefore, certain water-proof members can be mounted to the control module 50, or the control module 50 can be disposed above the liquid providing member 10 and the liquid collecting/draining member 80 to keep away from the pipeline.

The smart faucet equipment 100 further includes a light emitting module 90 electrically connected to the control module 50 as illustrated in FIG. 3. The light emitting module 90 includes a plurality of light emitting members 91 disposed on the liquid providing member 10 and surrounding the water outlet 11, the first liquid outlet 12 and the second liquid outlet 13. In the present embodiment, the light emitting members 91 are light emitting diodes which emit light with a wavelength ranging from 200 nm to 300 nm, preferably a far ultraviolet having a wavelength of 220 nm.

When the hands of a user approach the first sensor 60, the first sensor 60 generates the first signal and transmits the first signal to the control module 50. When the control module 50 receives the first signal, the processor of the control module 50 loads a first control program from the memory. The first control program actuates the valve 20, the first liquid pump 31 and the first sensor 60 according to a first control scheme which is determined by the custom of a user washing his/her body or objects. When the hands of a user approach the second sensor 70, the second sensor 70 generates the second signal and transmits the second signal to the control module 50. The control module 50 actuates the second liquid pump 41 and the second sensor 70 according to a second control scheme. The second control scheme is determined by a disinfection process desired by the user. The user may choose to activate the first sensor 60 or the second sensor 70 so as to start the wash mode or disinfection mode. The user may input or change the parameters in the first control scheme and the second control scheme.

Figure 6:
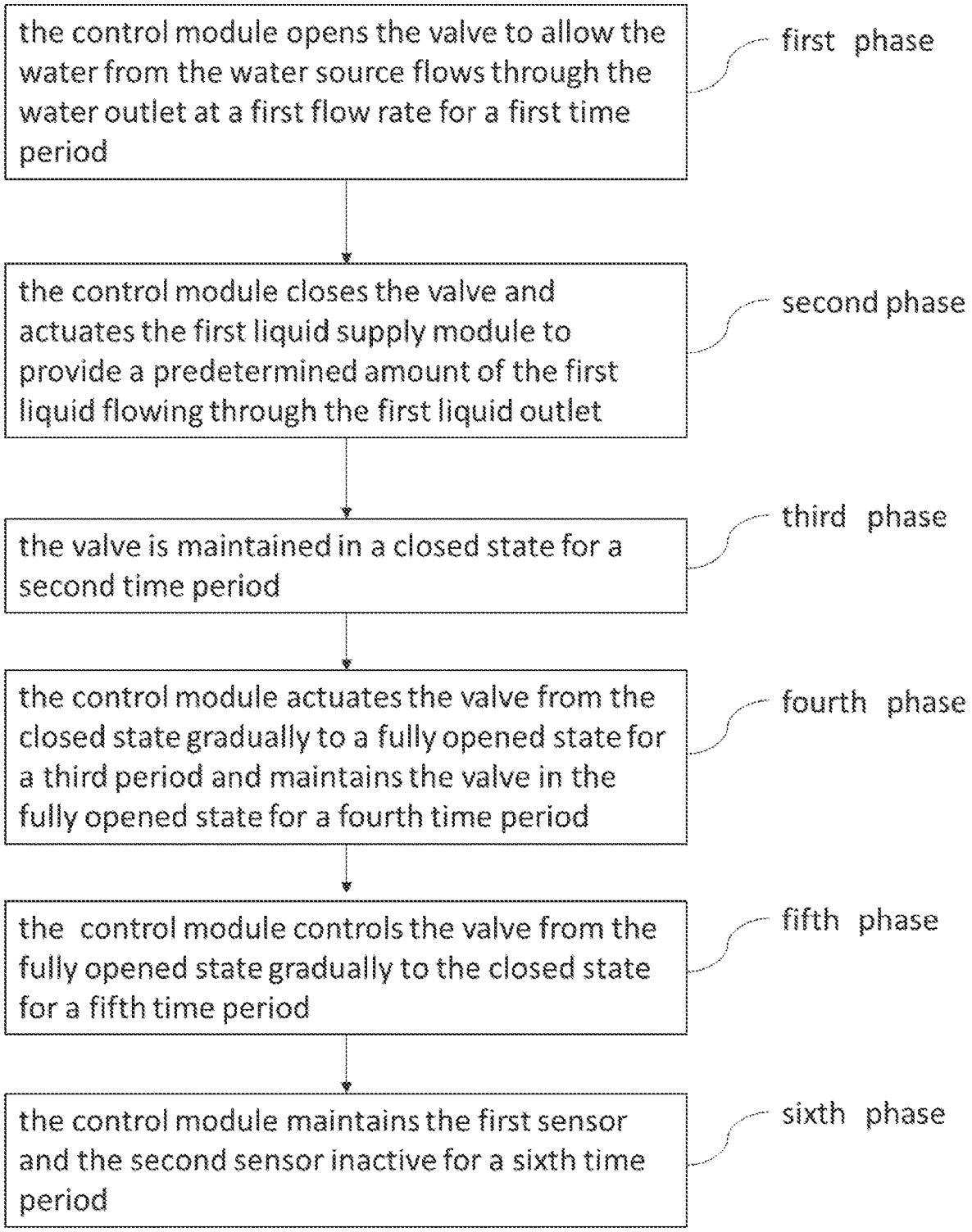
FIG. 6 is a standard flow diagram of the first control scheme for a smart faucet equipment/device of the present invention.

In the present embodiment, the first control scheme includes six phases. Please refer to FIG. 6, which is a standard flow diagram of the first control scheme for a smart faucet equipment/device of the present invention.

In the first phase, the control module 50 opens the valve 20 to allow the water to discharge from the water outlet 11 at a first flow rate in a first time period. For example, the control module 50 opens the valve 20 to discharge the water from the water outlet 11 at a flow rate which is 30% of the maximal flow rate for a time period of six seconds to wet the portion or objects of a user. Afterwards, the control process enters the second phase.

In the second phase, the control module 50 close the valve 20 and actuates the first liquid pump 31 to transfer a predetermined amount of the first liquid to the liquid providing member 10. The first liquid discharges from the first liquid outlet 12. Afterwards, the control process enters the third phase.

In the third phase, the valve 20 is maintained in a closed state for a second time period and the first liquid pump 31 stops. For example, the valve 20 is maintained in a closed state for a time period of 20 seconds, and the first liquid pump 31 stops. The user may rub his/her hands with the first liquid (the liquid soap or hand wash liquid) in the second time period. The second time period depends on the dirty level of the hand and the cleaning ability of the first liquid. The control process enters the fourth phase.

In the fourth phase, the control module 50 actuates the valve 20 from the closed state gradually to a fully opened state for a third period and maintains the valve 20 in the fully opened state for a fourth time period. For example, the control module 50 actuates the valve 20 from the closed state gradually to a fully opened state in a time period of 5 seconds and maintains the valve 20 in the fully opened state for 10 seconds. The user may pour water to his/her hands or objects to be washed in this time period to wash out the first liquid (the liquid soap and the hand wash liquid) and the dirty absorbed by the first liquid. The control process enters the fifth phase.

In the fifth phase, the control module 50 controls the valve 20 from the fully opened state gradually to the closed state in a fifth time period. For example, the control module 50 controls the valve 20 from the fully opened state gradually to the closed state in 5 seconds to stop providing water. The user may dry his/her body or the objects. The control process enters the sixth phase.

In the sixth phase, the control module 50 maintains the first sensor 60 and the second sensor 70 inactive for a sixth time period. For example, the control module 50 maintains the first sensor 60 and the second sensor 70 inactive for a time period of 5 seconds to prevent the same user from activating any one of the first sensor 60 and the second sensor 70 to enable the wash mode or disinfection mode again.

Figure 7:
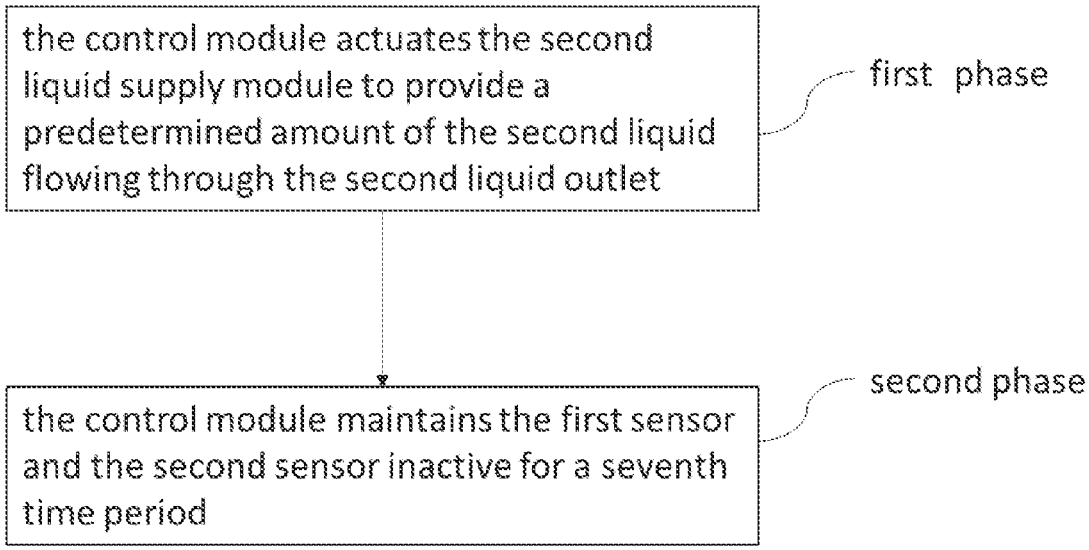
FIG. 7 is a standard flow diagram of the second control scheme for a smart faucet equipment/device of the present invention.

In the present embodiment, the second control scheme includes two phases. Please refer to FIG. 7, which is a standard flow diagram of the second control scheme for a smart faucet equipment/device of the present invention.

In the first phase, the control module 50 actuates the second liquid supply module 40 to provide a predetermined amount of the second liquid flowing through the second liquid outlet 13. At this time, the control module 50 inactivates the first sensor 60 to prevent the user from misactivating the first sensor 60 to activate the wash mode. The control process enters the second phase.

In the second phase, the control module 50 maintains the first sensor 60 and the second sensor 70 inactive for a seventh time period. For example, the control module 50 maintains the first sensor 60 and the second sensor 70 inactive for a time period of 5 seconds to prevent the same user from activating any one of the first sensor 60 and the second sensor 70 to enable the wash mode or disinfection mode again.

The control module 50 may control to turn on or off the light emitting members 91 of the light emitting module 90 to disinfect the hands of a user in the first control scheme and the second control scheme, particularly for the second control scheme corresponding to the disinfection mode. The control module 50 may enable the light emitting members 91 of the light emitting module 90 to emit light when the second liquid pump 41 pumps the second liquid.

The first time period, the second time period, the third time period, the fourth time period, the fifth time period, the sixth time period and the seventh time period of the first control scheme and the second control scheme may change according to the custom of a user. The user may input and save the value of the first time period, the second time period, the third time period, the fourth time period, the fifth time period, the sixth time period and the seventh time period in the control module 50. In another embodiment, the wash mode includes a plurality of sub-wash modes corresponding to various washing requirements. For example, the second time period, the third time period and the fourth time period can be set different values in the sub-wash modes. In another embodiment, the smart faucet equipment includes more than two liquid supply modules providing wash liquid of different cleaning abilities for general wash, medium wash or heavy wash corresponding to different dirty levels respectively. For example, the medium and heavy washes may be performed to clean the greasy dirt of the workers in a factory.

Figure 5:
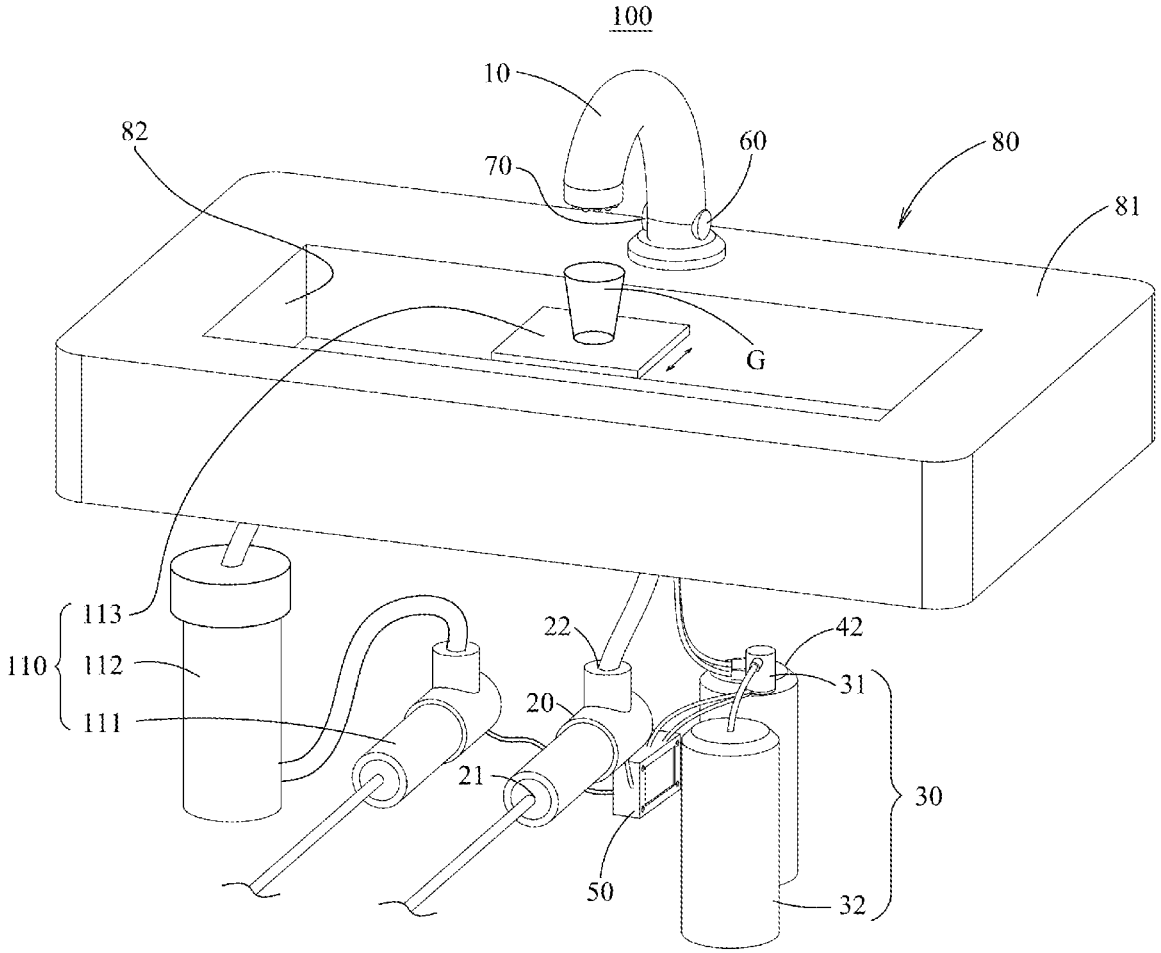
FIG. 5 is a perspective view of another embodiment of a smart faucet equipment/device of the present invention.

Referring to FIG. 5, another embodiment of the smart faucet equipment of the present invention is disclosed. Since the present embodiment has a structure partially identical to that of the embodiment shown in FIG. 1, the same elements in both embodiments are denoted by the same symbol, and the descriptions thereof are thus omitted. The present embodiment of the smart faucet equipment further includes a drinking water providing module 110. The drinking water providing module 110 includes a water providing valve 111, a water filter 112 and a carrying member 113. The water providing valve 111 has a water entrance connected to a water source and a water exit connected to the water filter 112. The carrying member 113 is mounted in a wall of the depression 82 of the liquid collecting/draining member 80 and can be pushed into the wall or pull out from the wall. The carrying member 113 is a plate provided with a pressure sensor. The water providing valve 111 and the carrying member 113 are electrically connected to the control module 50. The user can pull the carrying member 113 out from the wall and place a glass G on the carrying member 113. The pressure sensor detects the pressure caused by the weight of the glass G and generates a third signal which is transmitted to the control module 50. The control module 50 opens the water providing valve 111 when the control module 50 receives the third signal. The water providing valve 111 allow the water from the water source to flow through the water filter 112 and discharge from the water outlet 11. The filtered water discharged from the water outlet 11 can be the drinking water.

The smart faucet equipment 100 of the present embodiment further includes a third control scheme in addition to the first control scheme and the second control scheme. The third control scheme corresponds to a drinking mode. When the carrying member 113 is pulled out from the wall, the control module 50 executes the third control scheme in which the control module 50 maintains the first sensor 60 and the second sensor 70 inactive to prevent the user from mis-activating the first sensor 60 and the second sensor 70. The user places a glass G on the carrying member 113, and the control module 50 opens the water providing valve 111 to provide the drinking water from the liquid providing member 10. When the water in the glass G is full, the water providing valve 111 is closed by the control module 50. The user may place another glass on the carrying member 113, and the control module 50 opens the water providing valve 111 again to fill the drinking water into the glass. The drinking mode is maintained active until the carrying member 113 is pushed back into the wall. When the carrying member 113 is pushed back into the wall, the drinking mode is disabled and the first sensor 60 and the second sensor 70 is activated by the control module 50 again.

In another embodiment, a switch is disposed away from the first sensor 60 and the second sensor 70, and a third sensor is disposed between the first sensor 60 and the second sensor 70. The drinking mode is enabled when the user pushes the switch, and the user holds a glass under the liquid providing member 10 and detected by the third sensor, the control module 50 opens the water providing valve 111 to provide the drinking water.

In another embodiment, a heater is disposed in the pipeline of the water outlet 11. The heater is electrically connected to the control module 50 and regulates the water through the water outlet 11. The control module 50 controls the heater to heat the water through the water outlet 11 according to air temperature, or the water temperature can be set by the aforementioned input module to provide wash water or drinking water of appropriate temperature.

The smart faucet equipment of the present invention is provided with the valve providing water and the first liquid supply module providing the first liquid for the user to wash the hands. The smart faucet equipment of the present invention is also provided with the second liquid supply module providing the second liquid for the user to disinfect the hands. The control module actuates the valve and the first liquid supply module or actuates the second liquid supply module according to the first signal generated by the first sensor or the second signal generated by the second sensor respectively. The user may activate the first sensor or the second sensor according to his/her requirements for the purpose of hand wash or hand disinfection. Therefore, since the hand wash and hand disinfection is performed in the same equipment, the smart faucet equipment of the present invention provides more convenience for the user. In addition, the smart faucet equipment of the present invention determines the control schemes according to the user's customs and provides water or sanitizer for the user according to the control schemes, whereby the smart faucet equipment of the present invention can function automatically when the user activate the sensors. The user needs not to operate the faucet manually, and hence no public sanitation problems are rendered and more convenience is provided.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A smart faucet equipment, comprising:

a liquid providing member comprising a water outlet, a first liquid outlet and a second liquid outlet;

a valve connected to the water outlet and a water source;

a first liquid supply module connected to the first liquid outlet;

a second liquid supply module connected to the second liquid outlet;

a control module electrically connected to the valve, the first liquid supply module and the second liquid supply module;

a first sensor electrically connected to the control module; and a second sensor electrically connected to the control module; wherein when the first sensor detects an object, the first sensor transmits a first signal to the control module and the control module actuates the valve and the first liquid supply module based on a first control scheme, to provide water discharged from the water outlet that is connected to the water source and a first liquid discharged from the first liquid outlet that is connected to the first liquid supply module; and when the second sensor detects an object, the second sensor transmits a second signal to the control module and the control module actuates the second liquid supply module based on a second control scheme, to provide a second liquid discharged from the second liquid outlet that is connected to the second liquid supply module.

2. The smart faucet equipment as claimed in claim 1, further comprising a light emitting module electrically connected to the control module, wherein the light emitting module comprises a plurality of light emitting members disposed on the liquid providing member and surrounding the water outlet, the first liquid outlet and the second liquid outlet, the control module turns on or off the light emitting members according to the first control scheme or the second control scheme, and the light emitting members emit a light with a wavelength ranging from 200 nm to 300 nm.

3. The smart faucet equipment as claimed in claim 1, wherein the first liquid supply module comprises a first liquid pump and a first liquid container, the first liquid pump connects the first liquid container and the first liquid outlet, the first liquid pump is electrically connected to the control module, the control module actuates the first liquid pump according to the first control scheme, and the first liquid is stored in the first liquid container.

4. The smart faucet equipment as claimed in claim 3, wherein the second liquid supply module comprises a second liquid pump and a second liquid container, the second liquid pump connects the second liquid container and the second liquid outlet, the second liquid pump is electrically connected to the control module, the control module actuates the second liquid pump according to the second control scheme, and the second liquid is stored in the second liquid container.

5. The smart faucet equipment as claimed in claim 1, wherein the first liquid comprises wash liquid.

6. The smart faucet equipment as claimed in claim 1, wherein the second liquid comprises sanitizer.

7. The smart faucet equipment as claimed in claim 1, wherein the first sensor comprises a first light emitting member and a first light receiving member, the first light emitting member continues to emit infrared ray, and the first sensor generates the first signal when the first light receiving member receives an infrared ray reflected by the object.

8. The smart faucet equipment as claimed in claim 1, wherein the second sensor comprises a second light emitting member and a second light receiving member, the second light emitting member continues to emit infrared ray, and the second sensor generates the second signal when the second light receiving member receives an infrared ray reflected by the object.

9. The smart faucet equipment as claimed in claim 1, wherein the first sensor and the second sensor are disposed on two opposite sides of the liquid providing member.

10. The smart faucet equipment as claimed in claim 1, further comprising a liquid collecting/draining member disposed under the liquid providing member, and the water discharging from the water outlet enters the liquid collecting/draining member.

11. The smart faucet equipment as claimed in claim 1, in which the first control scheme comprises:

a first phase, in which the control module opens the valve to allow the water from the water source flows through the water outlet at a first flow rate for a first time period;

a second phase, in which the control module closes the valve and actuates the first liquid supply module to provide a predetermined amount of the first liquid flowing through the first liquid outlet;

a third phase, in which the valve is maintained in a closed state for a second time period;

a fourth phase, in which the control module actuates the valve from the closed state gradually to a fully opened state for a third period and maintains the valve in the fully opened state for a fourth time period;

a fifth phase, in which the control module controls the valve from the fully opened state gradually to the closed state for a fifth time period; and a sixth phase, in which the control module maintains the first sensor and the second sensor inactive for a sixth time period.

12. The smart faucet equipment as claimed in claim 1, in which the second control scheme comprises:

a first phase, in which the control module actuates the second liquid supply module to provide a predetermined amount of the second liquid flowing through the second liquid outlet; and a second phase, in which the control module maintains the first sensor and the second sensor inactive for a seventh time period.

* * * * *